United States Patent [19]

Vahle et al.

[11] 4,057,272

[45] Nov. 8, 1977

[54] ARM TOP COVER FOR LOCKING DEVICES

[75] Inventors: Erwin Vahle, Stutensee-Bl.; Helmut Tautz, Karlsruhe, both of Germany

[73] Assignee: The Singer Company, New York, N.Y.

[21] Appl. No.: 682,927

[22] Filed: May 4, 1976

[51] Int. Cl.[2] ..... E05C 19/10

[52] U.S. Cl. ..... 292/128

[58] Field of Search ..... 312/208; 112/258; 292/128, 102, DIG. 11

[56] References Cited

U.S. PATENT DOCUMENTS

| | | | |
|---|---|---|---|
| 2,695,581 | 11/1954 | Parry | 112/258 |
| 2,873,876 | 2/1959 | Reitzel | 292/128 |
| 3,735,701 | 5/1973 | Ackerman | 292/128 |

*Primary Examiner*—Paul R. Gilliam
*Assistant Examiner*—Kenneth J. Dorner
*Attorney, Agent, or Firm*—Edward L. Bell; Robert E. Smith

[57] ABSTRACT

A locking device for a top cover on a bracket arm of a sewing machine which employs a latching device of which the retractable bolt is associated with a thread guiding member shiftably supported on the bracket arm and projecting exteriorly thereof. When the cover is in place there are no visible latching devices or fastenings to detract from the overall appearance of the sewing machine.

4 Claims, 3 Drawing Figures

ARM TOP COVER FOR LOCKING DEVICES

BACKGROUND OF THE INVENTION

Most present day sewing machines have covers for accessing components located within the bracket arm. These covers are usually held on by screws going through holes in the cover. In addition to these holes being unsightly, a tool is required to remove covers thus fastened, and in using the tool, the finish on the cover around the holes is subject to getting scratched. In an attempt to eliminate these disadvantages, some sewing machines utilize spring clips on the underside of the cover, which are completely hidden from view when the cover is slid laterally into place. A problem, however, exists with this securing means, in that the cover may be inadvertently dislodged in the event that a lateral force is applied thereto.

SUMMARY OF THE INVENTION

It is the object of this invention to provide in a sewing machine an arrangement for securing a bracket arm top cover in place and which employs a latch on the inside of the cover of which the latch bolt is carried by a member shiftably supported on the sewing machine and carrying a thread guide exteriorly of the sewing machine so that a secure fastening is provided for the cover without detracting from the overall appearance of the sewing machine.

DESCRIPTION OF THE DRAWING

In the accompanying drawing of a preferred embodiment of the invention.

DESCRIPTION OF THE PREFERRED EMBODIMENT

Figure 1:
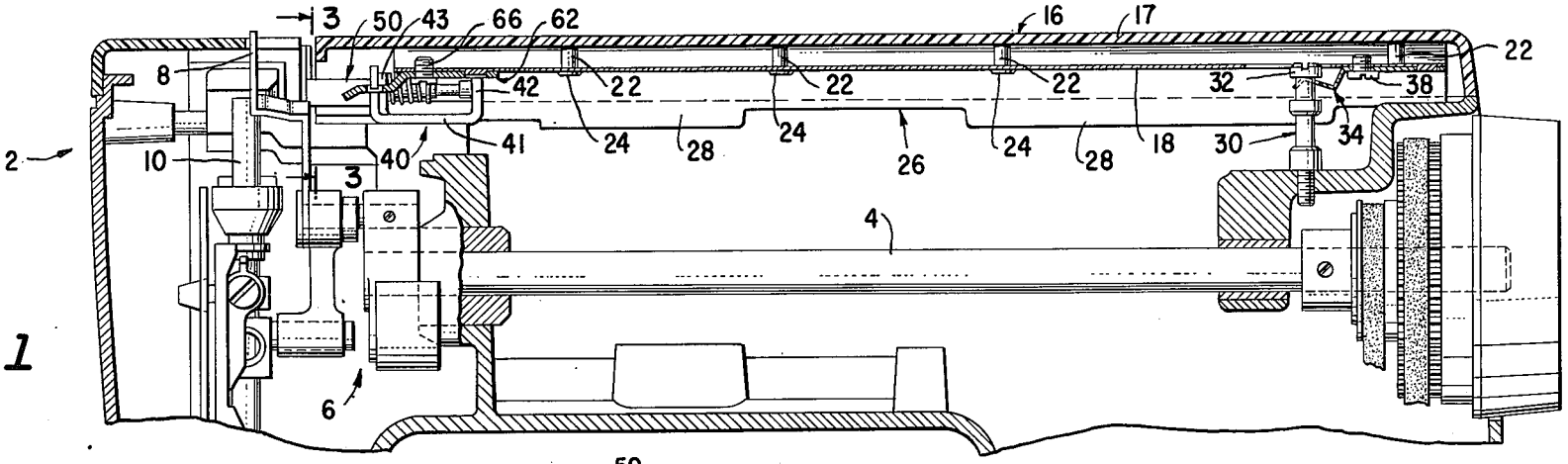
FIG. 1 is a front elevation, partly in section, of the bracket arm portion of a sewing machine with the bracket arm top cover locking device of this invention applied thereto.

Referring to the drawing for a detailed description of the invention, a sewing machine bracket arm is generally referred to by the reference number 2. Located within the bracket arm 2 is a drive shaft 4. Attached to the drive shaft 4 by suitable linkages 6 is a thread take-up 8 and a needle bar 10. In the top side of the bracket arm 2 is an opening 12 having formed along its front edge a lip 14. A cover assembly 16, including an outside cover 17 and an inside cover 18, is provided whose shape is congruent with the opening 12 in the bracket arm 2. The outside cover 17 has a front edge 20 which is formed to engage the lip 14 of the opening 12 such that the lip 14 provides a means for limiting the forward movement of the cover assembly 16.

The outside cover 17 also has bosses 22 formed in its underside, to which is secured by fastening means, such as rivets 24, the inside cover 18. The inside cover 18 has a rear edge 26 which is formed into guides 28 for engaging the inside rear edge of opening 12 in the bracket arm 2 limiting the rearward movement of the cover assembly 16.

Secured in the bracket arm 2 and located on the right side of the opening 12 as view in FIG. 1 and extending upward therein, is a stud 30 which is formed with a head portion 32. Correspondingly located on the underside of the inside cover 18 is a spring clip 34 having one end formed in a fork 36 for engaging the head portion 32 of the stud 30. The spring clip 34 is secured to the indside cover 18 by a screw 38.

Situated in the bracket arm 2 and located at the left side of opening 12 as viewed in FIG. 1, is a pivot support 40. The pivot support 40 has a base 41 and two parallel vertical sections, 42 and 43 depending from opposite ends of the base 41. The base 41 is formed with two holes, 44 and 45 through which screws 46 and 47 are passed securing the pivot support 40 to the bracket arm 2. Connecting the two vertical sections, 42 and 43 is a pivot 48. A bracket 50 is pivotally attached at its midpoint to the pivot 48. A first limb 52 of the bracket 50, extending from the pivot 48 and within the bracket arm 2, is formed with downward turned tangs 54. A second limb 56 of the bracket 50 extends from the pivot 48 to the outside of the bracket arm 2 through a hole 58 therein. This second limb 56 of the bracket 50 terminates outside the bracket arm 2 in an offset thread guiding finger 59 adjacent to which a pretension device 60 is secured.

Figure 2:
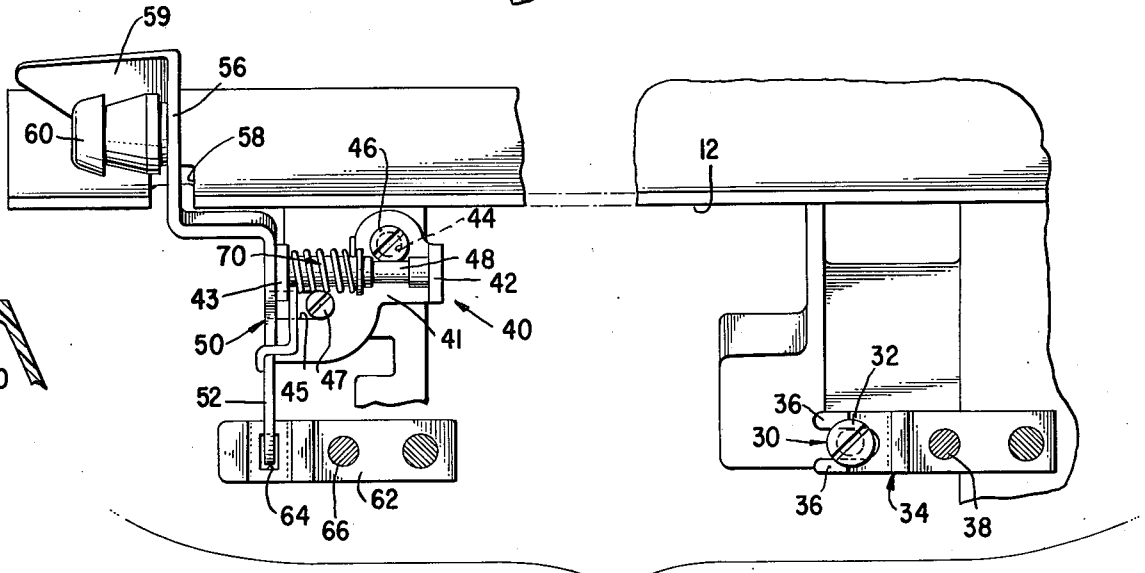
FIG. 2 is a top view of the sewing machine bracket arm of FIG. 1 with the top cover removed but just the interengaging latch elements which are carried on the cover in the positions which they occupy when the cover is locked on the bracket arm.
Figure 3:
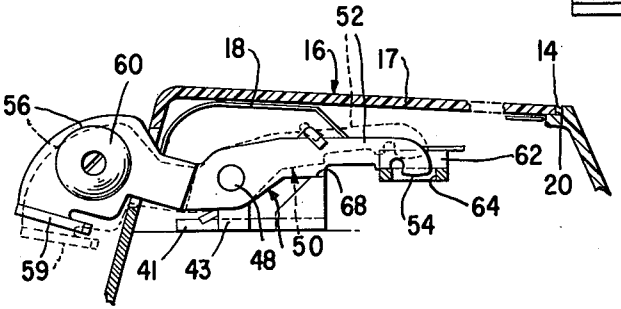
FIG. 3 is a cross-sectional view taken along the line 3–3 in FIG. 1, showing the top cover assembly and the locking device in place.

Affixed to the underside of the inside cover 18 adapted to cooperate with the tangs 54 of the bracket 50 is a latch block 62. The latch block 62 is formed with a hole 64 which as shown in FIGS. 2 and 3 is positioned so as to accomodate the tangs 54 when the cover is in place on the bracket arm 2. The latch block 62 is secured to the inside cover 18 by a screw 66 and preferably projects from the screw 66 in spaced relation to the inside cover 18 such that the tangs 54 of the bracket 50 may engage the hole 64 from between the latch block 62 and the inside cover 18.

The pivot support 40 is also formed with a stop 68 for limiting movement of the first limb 52 of the bracket 50 in the direction of engagement of the tangs 54. Biasing means, in the form of a coil spring 70, is provided for urging the first limb 52 of the bracket 50 against the stop 68.

For installation, the cover assembly 16 is placed over the opening 12 spaced somewhat to the right thereof. While pressing down on the thread guiding finger 59 of the second limb 56 of the bracket 50 so as to elevate the tangs 54, the cover assembly 16 is slid to the left, causing the fork 36 in the spring clip 34 to engage the head portion 32 of the stud 30. In the process of sliding the cover assembly 16 to the left, the lip 14 and the guides 28 act to constrain the cover assembly 16 from moving either frontwardly or backwardly with respect to the bracket arm 2 allowing movement only to the left or right. After the cover assembly 16 is fully seated, the second limb 56 of the bracket 50 may be released causing the tangs 54 in the first limb 52 of the bracket 50 to engage the hole 64 in the latch block 62 thereby locking the cover assembly 16 in position. To remove the cover, assembly 16, it is necessary first to depress the thread guiding finger 59 and then, while depressing the thread guiding finger 59, to apply a lateral force to the cover assembly 16, sliding the cover assembly 16 to the right as viewed in FIGS. 1 and 2. Since this combination of actions is not likely to occur by accident, and since neither of these actions when applied individually will have any effect in dislodging the cover assembly 16, inadvertent detachment of the cover assembly 16 is practically impossible with the present invention.

Having thus set forth the nature of the invention, what we claim is:

1. In a sewing machine having a bracket arm with a removable top cover, a top cover locking device comprising:

a. a pivot support attached within said bracket arm and located substantially beneath said removable top cover;

b. a bracket pivotally attached at its mid-point to said pivot support forming a first and a second limb, said first limb extending inside said bracket arm from said pivot support, said bracket arm being formed with a hole therein through which said second limb, extending from said pivot support, projects;

c. engaging means on said bracket arm and said top cover for assuring a proper assembled relation therebetween;

d. cooperating latch means formed on said first bracket limb and on said top cover, said cooperating latch means being arranged for interlocking engagement when said top cover occupies said assembled relation on said bracket arm; and e. cooperating clip means formed in said bracket arm and on said top cover, said cooperating clip means being arranged for interlocking engagement, in concert with said cooperating latch means, when said top cover occupies said assembled relation on said bracket arm.

2. A locking device as set forth in claim 1 wherein said cooperating latch means comprises a latch block attached to said top cover having a hole therein and tangs formed in said first bracket limb for interlocking engagement with said hole in said latch block.

3. A locking device as set forth in claim 2 wherein said pivot support further comprises a stop for limiting the movement of said first bracket limb in the direction of engagement with said latch block.

4. A locking device as set forth in claim 3 wherein said pivot support further comprises biasing means for urging said first bracket limb against said stop.

* * * * *